US011535445B2

(12) United States Patent
Padilla

(10) Patent No.: US 11,535,445 B2
(45) Date of Patent: Dec. 27, 2022

(54) CARRIER AND BLANK THEREFOR

(71) Applicant: WestRock Shared Services, LLC, Atlanta, GA (US)

(72) Inventor: Jesus A. Padilla, Hoschton, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 20 days.

(21) Appl. No.: 17/072,652

(22) Filed: Oct. 16, 2020

(65) Prior Publication Data

US 2021/0114797 A1 Apr. 22, 2021

Related U.S. Application Data

(60) Provisional application No. 62/915,792, filed on Oct. 16, 2019.

(51) Int. Cl.
*B65D 83/08* (2006.01)
*B65D 5/02* (2006.01)
*B65D 5/50* (2006.01)

(52) U.S. Cl.
CPC ..... *B65D 83/0841* (2013.01); *B65D 5/0227* (2013.01); *B65D 5/5019* (2013.01)

(58) Field of Classification Search
CPC ..... B65D 71/00; B65D 69/00; B65D 5/029; B65D 5/4266; B65D 5/0227; B65D 5/0236; B65D 5/0254; B65D 5/0263; B65D 5/0272; B65D 5/0281; B65D 5/248; B65D 5/22; B65D 5/2483; B65D 83/0882; B65D 83/0841; B65D 85/672; B65D 5/5415; B65D 2583/087; B65D 5/6602; Y10T 225/248; Y10T 225/243; B65H 35/002
USPC ..... 206/225, 226, 395, 408, 397, 588.4; 229/93, 181, 182, 165, 198, 190; 220/62; 225/48, 43, 49, 91
See application file for complete search history.

(56) References Cited

U.S. PATENT DOCUMENTS 2,336,842 A * 12/1943 Broeren ..... B65D 83/0841 225/49
3,531,041 A * 9/1970 Rohde ..... B65D 5/248 229/199
3,854,651 A * 12/1974 Osborne ..... B65D 5/4295 229/160
3,942,417 A * 3/1976 Finn ..... B65D 83/0882 225/49
3,974,947 A * 8/1976 Budny ..... A47K 10/3827 225/53
4,005,809 A * 2/1977 Finn ..... B65D 83/0882 225/49
4,130,228 A * 12/1978 Perrin ..... B65H 35/0006 225/49
4,346,830 A * 8/1982 Hauser ..... B65H 35/008 225/49
4,371,104 A * 2/1983 Korte ..... B65D 83/0882 225/48

(Continued)

*Primary Examiner* — Anthony D Stashick
*Assistant Examiner* — Prince Pal
(74) *Attorney, Agent, or Firm* — Brian J. Goldberg

(57) ABSTRACT

Aspects of the invention are directed toward a folded carton (90) for holding a roll (R) of film web (F) such as catering foil and the like, having an integral feature (S1. S2) to assist with retention of the roll (R) of film web (F), to mitigate against the roll undesirably, inadvertently, falling out of the folding carton (90) during use.

28 Claims, 4 Drawing Sheets

(56) References Cited

U.S. PATENT DOCUMENTS 4,405,066 A * 9/1983 Roccaforte ..... B65H 35/0006 225/48
4,417,678 A * 11/1983 Roccaforte ..... B65H 35/0006 225/48
4,989,735 A * 2/1991 O'Brien ..... B65D 5/701 229/207
5,145,109 A * 9/1992 Faulstick ..... B65D 5/6626 206/395
5,288,012 A * 2/1994 DeMay ..... B65D 5/5415 229/905
5,511,663 A * 4/1996 Shimura ..... B65D 83/0841 206/408
6,405,913 B1 * 6/2002 Passamoni ..... B65H 35/008 225/49
6,817,162 B1 * 11/2004 Gerulski ..... B65D 83/0805 206/397
7,043,888 B2 * 5/2006 Gerulski ..... B65D 83/0805 206/397
2002/0117529 A1 * 8/2002 Gerulski ..... B65D 83/0805 493/162
2002/0117530 A1 * 8/2002 Gerulski ..... B65D 83/0805 493/162
2003/0091779 A1 * 5/2003 Brewster ..... B65D 83/0841 428/34.2
2003/0164392 A1 * 9/2003 Gerulski ..... B65D 83/0841 225/48
2004/0065575 A1 * 4/2004 Gerulski ..... B65D 83/0805 206/397
2005/0072826 A1 * 4/2005 Sewell ..... B65D 83/0841 225/49
2007/0095881 A1 * 5/2007 Manaige ..... B65D 5/5425 229/101.2
2010/0213230 A1 * 8/2010 Saakl ..... B65D 83/0841 225/39
2015/0344256 A1 * 12/2015 Kaiser ..... B65H 35/002 242/562
2018/0305164 A1 * 10/2018 Smith ..... B65D 83/0864
2020/0156861 A1 * 5/2020 Padilla ..... B65D 5/542
2021/0292043 A1 * 9/2021 Medrano ..... B65D 83/0882

* cited by examiner

CARRIER AND BLANK THEREFOR

CROSS REFERENCE TO RELATED APPLICATIONS

This application claims priority to U.S. Provisional Patent Application No. 62/915,792, filed Oct. 16, 2019. The entire contents of this application are incorporated herein by reference in their entirety.

TECHNICAL FIELD

The present invention relates to a re-closeable folding carton for holding a web roll of material such as plastic wrap, aluminum foil, and the like. More specifically, but not exclusively, the invention relates to a folding carton having an integral retaining device feature which mitigates against the roll undesirably or inadvertently falling out of the folding carton when open.

BACKGROUND

In both domestic households and in the catering and hospitality industries, food preparation and storage products, such as foil, baking paper, films and the like, are used, for example, to preserve the freshness of a foodstuff and/or assist in the baking or roasting of a food product. Many applications exist for such films, plastic wraps, grease-proof paper, baking paper, oven liners, foils and the like. Such products are typically provided in rolled form, with a web of film wound around a roll. It is known to house such film-rolls in an outer protective package, which keeps the roll clean and provides a branding surface for use during retail.

For example, in EP 2,586,728, a package for films for product freshness is disclosed which aims to improve handling by a user when gripping and peeling the film web. The package disclosed therein comprises a film roll arranged such that one end of the film web, that is wound on the film roll, emerges from an opening. An adhesive is provided on an outside of the package, by means of which the end of the film web is detachably fixable. This enables a user to be able to easily find the leading end of the film web and prevents it from being re-wound onto the film-roll. On the outside of the package, protruding from at least one wall, a tab is formed; and the adhesive for detachably fixing the film web is provided on the surface of the tab for releasably fixing the end of the film web.

A known problem associated with packages or carriers for film-rolls is that once the carrier has been opened, the film-roll is vulnerable to accidental egress from the carton. However, because it is desirable for the film web to be able to unwind from the roll in an unfettered manner during deliberate dispensing of the film web, any means for retaining the film-roll will not provide a good solution if it actually interferes with the dispensing of the film. Worse still, if the means for retaining the film-roll actually causes a snagging point, it can result in undesirable tearing of the film and lead to frustration for the end-user and possible wastage.

In US2008190257 a dispenser is disclosed which has a hollow elongated rectangular base in which a roll of pliable material such as plastics film for dispensing from the dispenser is supported rotatably by means of end supports for rotational movement about its longitudinal axis. The dispenser additionally includes an upper cover incorporating a severing mechanism. The cover includes a fixed body part and an upper jaw carrier pivotally coupled to the fixed body part and a second jaw carrier part, as well as a blade for severing the dispensed film. Such dispensers are of the re-fillable type, typically formed from a thermoplastic material. As such they can be expensive to produce and limit a customer's future purchasing choices to only the compatible re-fill film-rolls sized especially for the re-fillable dispenser. Such dispensers are not necessarily recyclable. Accordingly, it is desirable to overcome these and other drawbacks associated with prior art film-roll dispensers.

Other considerations in the field of dispensing-cartons for housing film-rolls, having a web of material wound thereon, include: the strength of the carton and its suitability for holding and transporting the film-roll and web; use of eco-friendly materials; the ease of which the dispensing carton can be initially opened by a user; and the ease with which a user can grasp the leading or emerging edge of the film for dispensing. It is desirable for the dispensing-carton to be recloseable; and for any re-closing mechanism to be suitable for repeated use without failure or damage. For cost and environmental considerations, such cartons or carriers need to be formed from as little material as possible and cause as little wastage in the materials from which they are formed as possible. Furthermore, it is desirable for the carrier to be erectable from a blank of foldable sheet material using automated gluing and folding machinery.

The present invention seeks to provide an improvement in the field of cartons, typically formed from paperboard or the like suitable for housing and facilitating the dispensing of a wound roll of webbed material, such as but not limited to substrates such as foil, baking paper, films and the like. It will be appreciated that the present invention may have many and various applications, including applications outside of the food industry. For example, a roll of a paper-based material, such as tracing paper, art paper, graph paper, squared paper or the like, may be housed in a carton of the present disclosure for use in a wide variety of places including homes, craft and art groups, businesses and offices, schools, colleges and other educational establishments, as mere examples.

SUMMARY

A first aspect of the present disclosure provides a carton for storing and dispensing a rolled web of material, the carton comprising: a rear wall, a bottom wall, a front wall, a first end wall and a second end wall arranged to form a tubular roll-storage container; a closure that is hinged to a top edge of said rear wall, the closure comprising a top panel and a lid panel, the lid panel being hinged to the top panel; and the carton comprising at least a first retaining device having a first portion hinged to the rear wall; and a second portion hinged to the first end wall, the first and second portions being affixed together.

The affixed first and second portions are spaced from and overhang the bottom wall of the carton.

The lid panel is optionally directed downward so that the lid panel is located substantially adjacent an upper portion of the front wall of the tubular roll storage container when the carton is closed.

The carton is optionally a folded structure formed from sheet materials, such as paperboard and the like.

Optionally, said first retaining device has a width that is less than the width of the first end wall. Optionally, said first retaining device is free of direct connection to the front wall. Optionally, a front edge of said first retaining device is spaced from the front wall and is acutely angled relative to a top edge of the first end wall. Optionally, said first portion of said first retaining device is provided by a first retention tab that is formed from material that would otherwise have formed part of the top panel. Optionally, said first portion of said first retaining device is defined by: a free edge of the top panel; part of a fold line between the top panel and the rear wall; a severance line which defines said front edge; and a partial cut line.

Optionally, said partial cut line extends approximately perpendicularly relative to said fold line between the top panel and the rear wall; and wherein said severance line is formed generally contiguously with the partial cut line and extends at an angle relative thereto. Optionally, said first portion of said first retaining device is further defined by a reverse partial cut oriented substantially parallel to the partial cut line, and said reverse partial cut may be angled at one end and terminates on said partial cut line. Optionally, a thin section of the first portion of said first retaining device has a thickness that is less than the thickness of the remainder of the first portion; and the thin section of the first portion may be defined by the partial cut line and the reverse partial cut.

Optionally, the first end wall comprises: first, second and third end closure flaps hinged to the front wall, bottom wall and rear wall respectively, the first, second and third end closure flaps being affixed together and said second portion of said first retaining device may be provided by a first supplementary securing flap that is hinged by a fold line to first end wall. Optionally, the first supplementary securing flap is hinged by a fold line to the second end closure flap.

Optionally, the carton has a second retaining device, the second retaining device being formed at the opposite end of the tubular roll storage container to the first retaining device. Optionally, the second retaining device comprises: a first portion hinged to the rear panel; and a second portion hinged to the second end wall and wherein the first and second portions are affixed together.

Optionally, said second retaining device has a width that is less than the width of the first end wall, said second retaining device may be free of direct connection to the front wall; and a front edge of said second retaining device may be spaced from the front wall and may be acutely angled relative to a top edge of the first end wall.

Optionally, said first portion of said second retaining device is provided by a second retention tab that is formed from material that would otherwise have formed part of the top panel; and may be defined by: a free edge of the top panel; part of a fold line between the top panel and the rear wall; a severance line which defines said front edge; and a partial cut line. Optionally, said partial cut line extends approximately perpendicularly relative to said fold line between the top panel and the rear wall. Optionally, said severance line is formed generally contiguously with the partial cut line and extends at an angle relative thereto. Optionally, said first portion of said second retaining device is further defined by a reverse partial cut oriented substantially parallel to the partial cut line; and said reverse partial cut may be angled at one end and terminates on said partial cut line. Optionally, a thin section of the first portion of said second retaining device has a thickness that is less than the thickness of the remainder of the first portion; and the thin section of the first portion is defined by the partial cut line and the reverse partial cut.

Optionally, the second end wall comprises: fourth, fifth and sixth end closure flaps hinged to the front wall, bottom wall and rear wall respectively, the fourth, fifth and sixth end closure flaps being affixed together and said second portion of second first retaining device may be provided by a second supplementary securing flap that is hinged by a fold line to first end wall. Optionally, the second supplementary securing flap is hinged by a fold line to the fifth end closure flap.

According to another aspect of the disclosure, there is provided a foldable paperboard blank for forming a folded paperboard carton for storing and dispensing a rolled web of material, the blank comprising: a rear wall panel, a bottom wall panel, a front wall panel, flaps for forming a first end wall and flaps for forming a second end wall, which together defined a tubular roll storage container; panels for forming a closure comprising: a top panel; and a lid panel, the lid panel being connected to the top panel along a fold line; and components for forming at least a first retaining device, said components comprising: a first portion hinged to the rear panel; and a second portion hinged to a flap for forming first end wall, the first and second portions for being affixed together, wherein said first portion of said first retaining device is provided by a first retention tab that is formed from material that would otherwise have formed part of the top panel.

Optionally, said first portion of said first retaining device is defined by: a free edge of the top panel; part of a fold line between the top panel and the rear wall; a severance line which defines said front edge; and a partial cut line. Optionally, said partial cut line extends approximately perpendicularly relative to said fold line between the top panel and the rear wall; and said severance line may be formed generally contiguously with the partial cut line and may extend at an angle relative thereto.

Optionally, said first portion of said first retaining device is further defined by a reverse partial cut oriented substantially parallel to the partial cut line, and wherein said reverse partial cut is angled at one end and terminates on said partial cut line.

Optionally, the components for forming the first end wall comprise: first, second and third end closure flaps hinged to the front wall, bottom wall and rear wall respectively, wherein said second portion of said first retaining device is provided by a first supplementary securing flap that is hinged by a fold line to the second end closure flap.

Optionally, the blank has components for forming a second retaining device comprising: a first portion hinged to the rear panel; and a second portion hinged to a flap for forming the second end wall, wherein the first and second portions are for being affixed together. Optionally, said first portion of said second retaining device is provided by a second retention tab that is formed from material that would otherwise have formed part of the top panel; and is defined by: a free edge of the top panel; part of a fold line between the top panel and the rear wall; a severance line which defines said front edge; and a partial cut line.

Optionally, said partial cut line extends approximately perpendicularly relative to said fold line between the top panel and the rear wall panel. Optionally, said severance line is formed generally contiguously with the partial cut line and extends at an angle relative thereto. Optionally, said first portion of said second retaining device is further defined by a reverse partial cut oriented substantially parallel to the partial cut line. Optionally, said reverse partial cut is angled at one end and terminates on said partial cut line.

Optionally, the second end wall comprises: fourth, fifth and sixth end closure flaps hinged to the front wall, bottom wall and rear wall respectively, the fourth, fifth and sixth end closure flaps for being affixed together. Optionally, said second portion of second first retaining device is provided by a second supplementary securing flap that is hinged by a fold line to first end wall.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the carriers, blanks and methods are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the carriers, blanks and methods described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
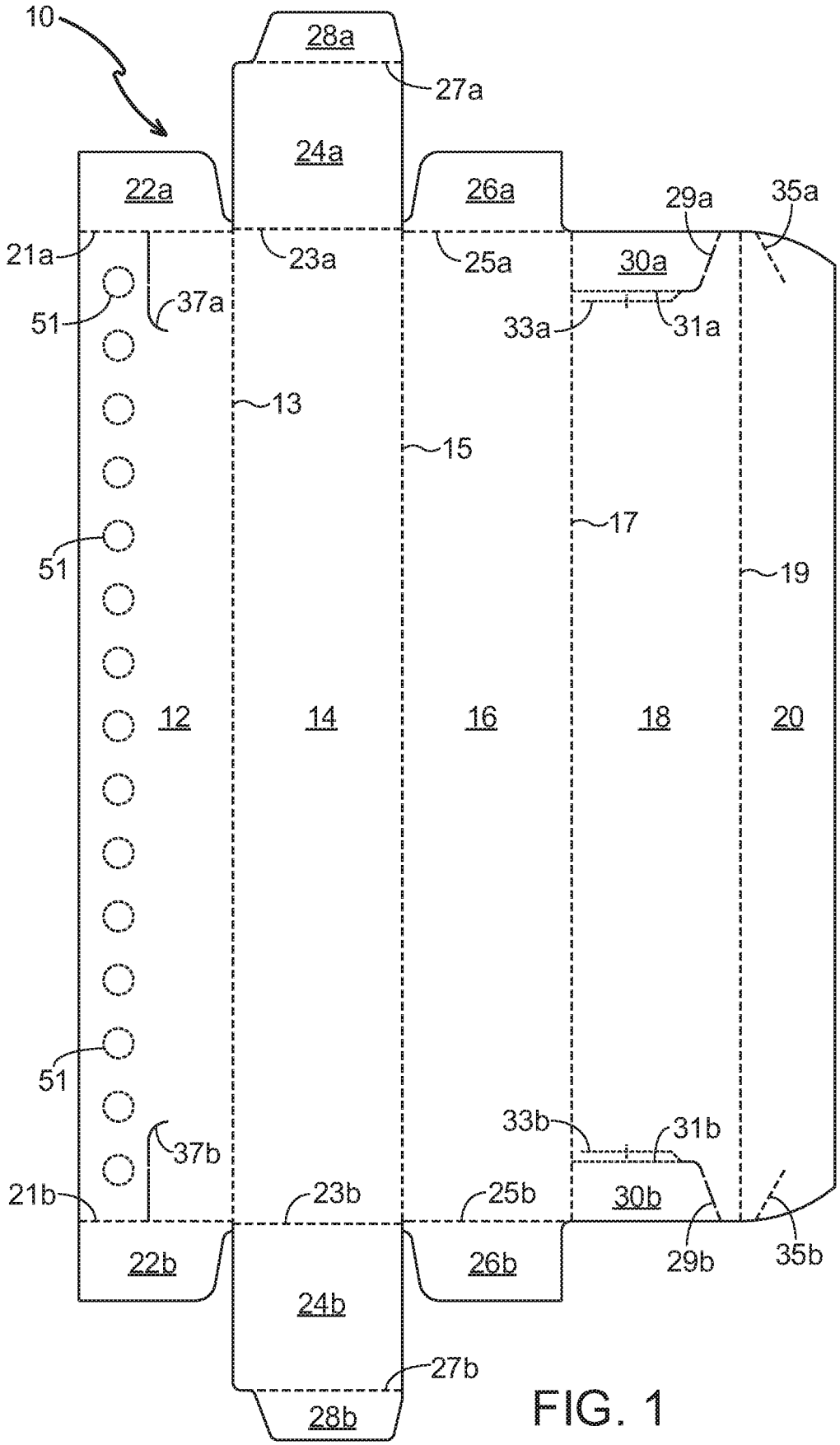
FIG. 1 is a plan view from above of a blank for forming a carton according to an embodiment of the disclosure.
Figure 2:
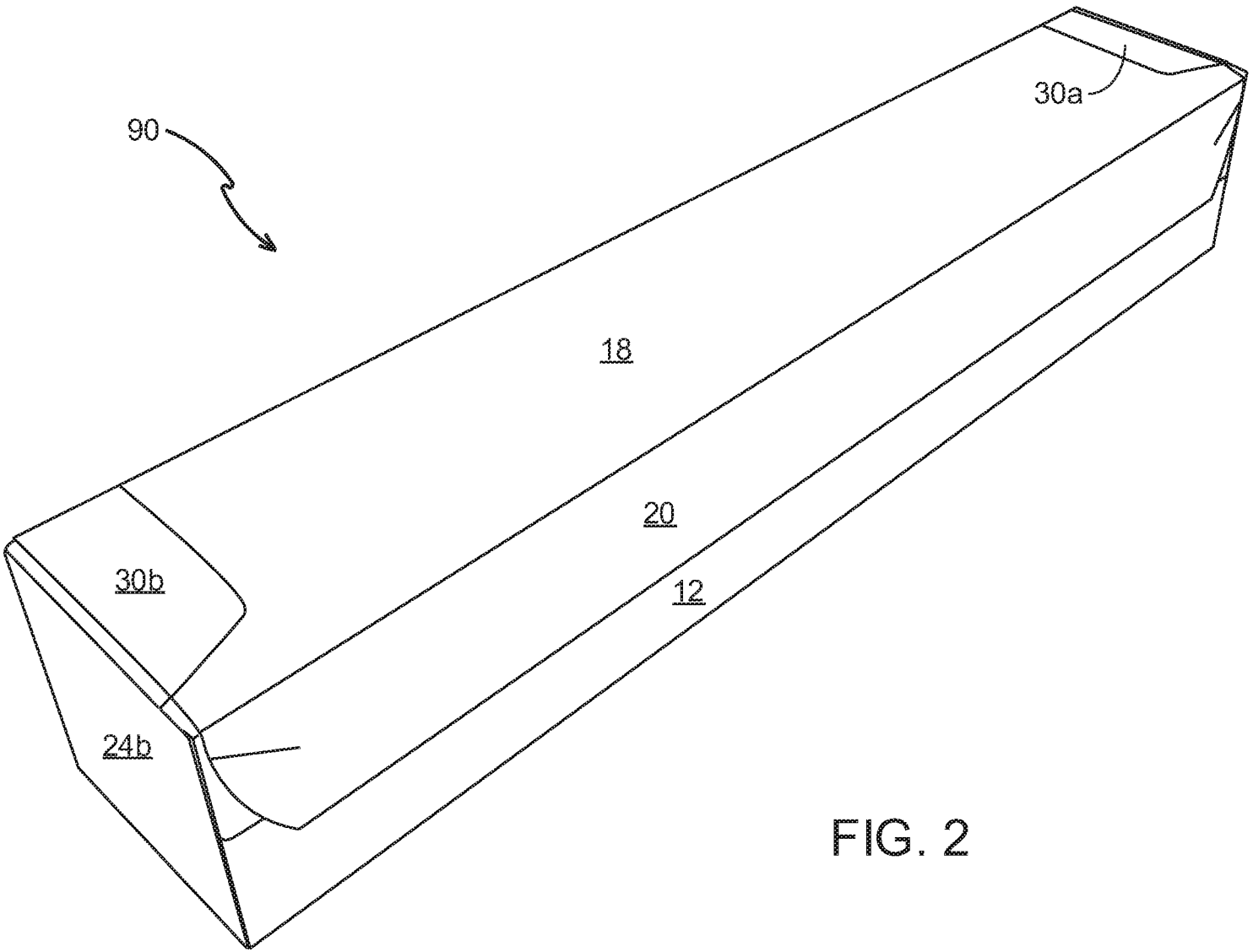
FIG. 2 is a perspective view from above of an assembled carrier, loaded with a roll of foil web, and secured in an initial closed condition.
Figure 3:
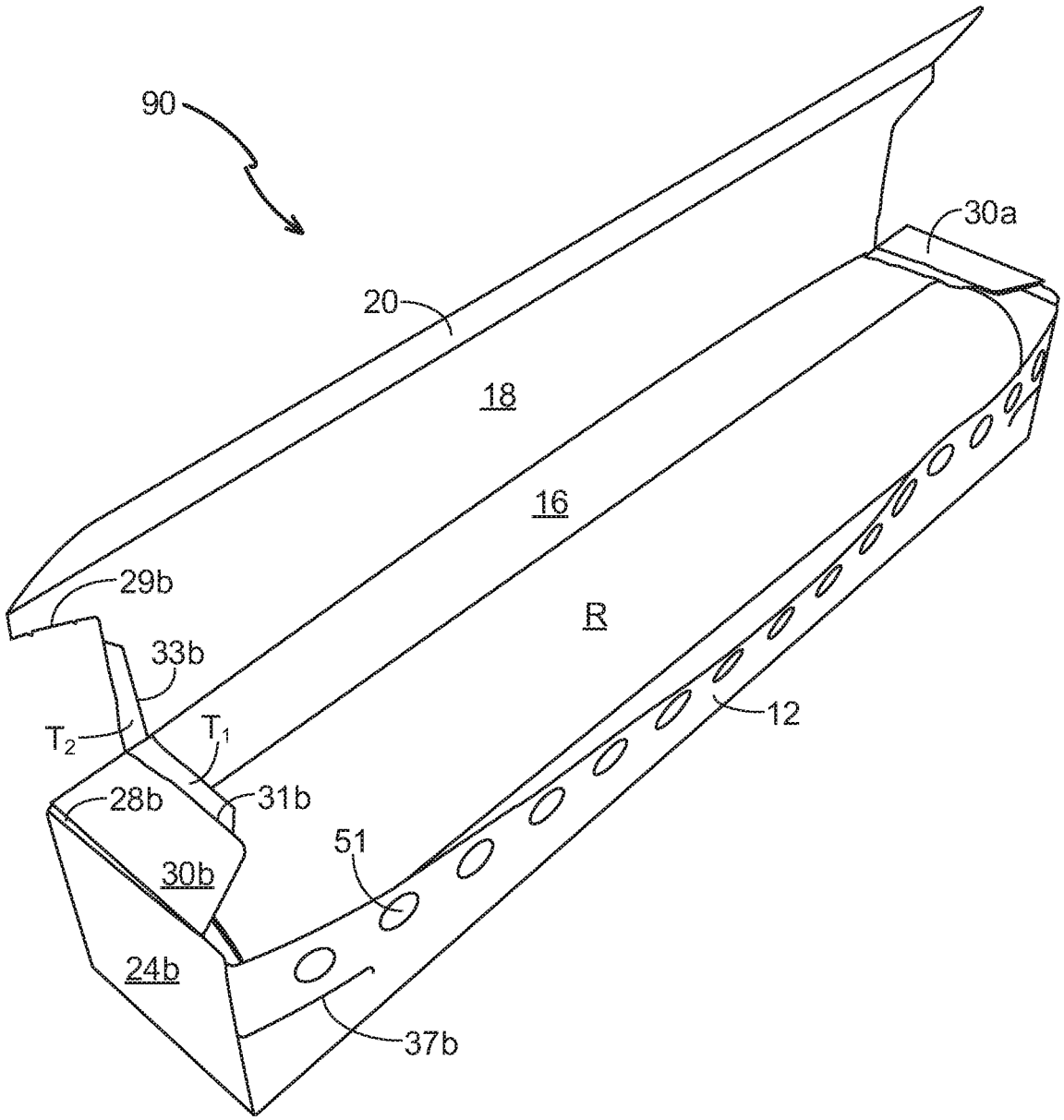
FIGS. 3 and 4 are views from above of the carrier of FIG. 2 in an opened and dispensing condition respectively, wherein retaining devices, automatically set-up upon opening the carton, are in use, keeping the foil-roll within the carton.
Figure 4:
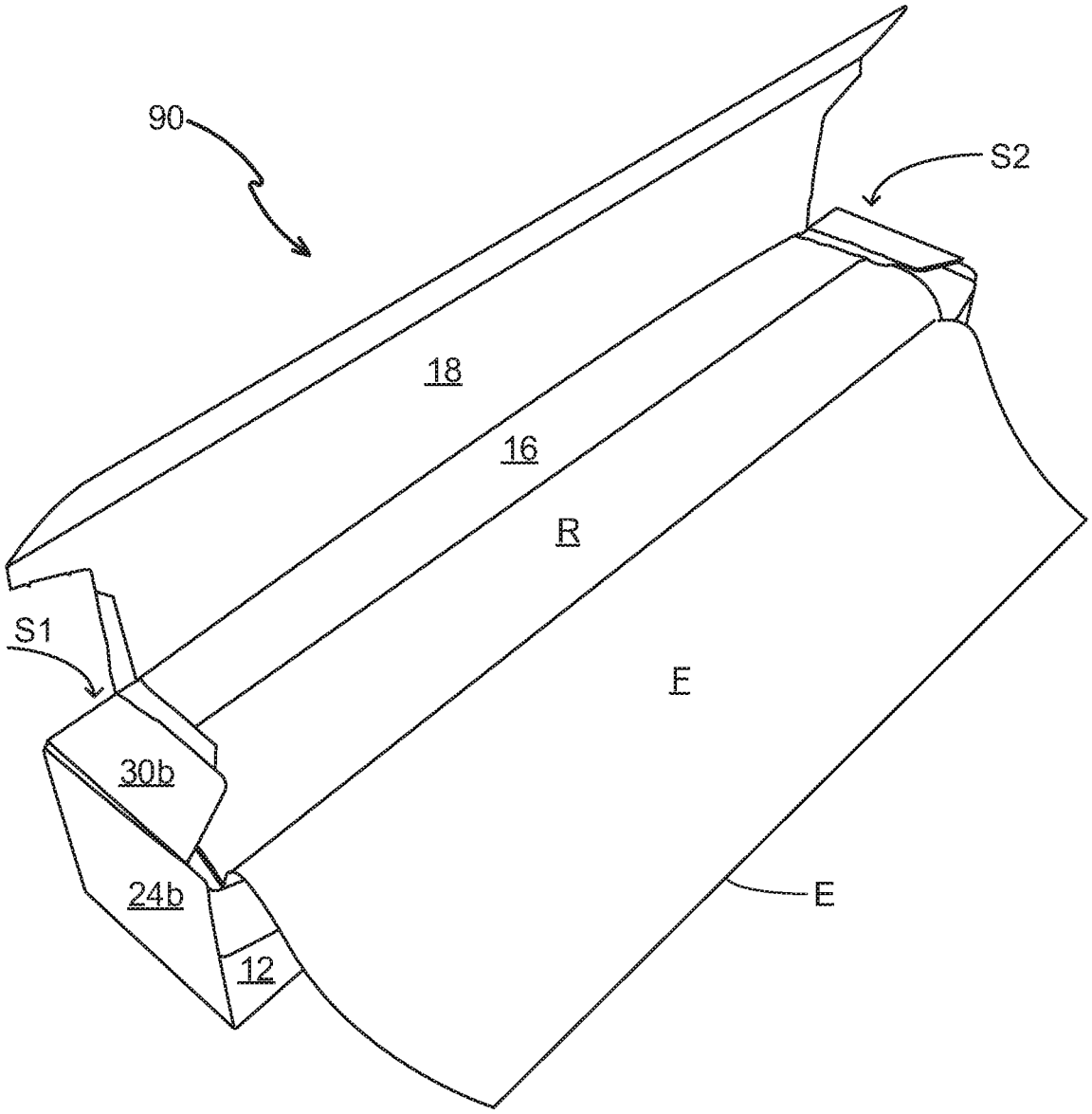

Referring to FIG. 1, there is shown a plan view of a blank 10 capable of forming a roll-holding, recloseable folding-carton or carrier 90, as shown in FIGS. 2, 3 and 4, for holding a product such as, but not limited to a web, film or substrate of planar, flexible material 'F', wound on a roll 'R'. The wound film 'F' may include materials, such as but not limited to: aluminium foil, baking paper, cling-film, plastic wrap, grease-proof paper, oven liner material, pre-cut baking sheets, pre-cut baking foil sheets, other paper-based material, such as tracing paper, art and craft paper, graph paper, and squared paper. It will be appreciated that the dispensing carrier 90 of present invention may have many and various applications for holding a rolled web 'R' of material 'F' and such applications may include, as mere examples only, domestic use, food catering and hospitality industry, offices, schools and other educational establishments. Whereas in the foregoing description, refence is made to a web of material 'F' wound on a roll 'R', it will be appreciated that a wound web of material 'F' may be formed on a mandrel and then removed therefrom, accordingly the presence of an actual roll per se is not necessary. Furthermore, whereas reference in the foregoing may be made to a web of material 'F' in the singular, which web can be cut to size by the end user as required, the dispensing carrier 90 disclosed herein may also be useful in holding a rolled web 'R' containing a contiguous series of individual, cut or part-cut lengths or sheets of film or web material 'F'.

Referring now to the blank 10 itself, the blank 10 is formed from a sheet of suitable substrate. It is to be understood that, as used herein, the term "suitable substrate" in reference to the blank 10 includes all manner of foldable sheet material such as paperboard, corrugated board, cardboard, plastic, combinations thereof, and the like. It should be recognised that one or other numbers of blanks may be employed, where suitable, for example, to provide the carrier structure 90 described in more detail below.

The packaging structures or cartons described herein may be formed from a sheet material such as paperboard, which may be made of, or coated with, materials to increase its strength, tear resistance or moisture resistance. Examples of such sheet material are PrintKote® Poly paperboard and CustomKote™ Poly paperboard made by WestRock Company. It should be noted that the resistant materials may be provided by more than one layer, to help improve the moisture or tear resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of moisture resistance, tear-resistance, good glue-ability, heat sealability, or other desired functional properties.

The blank 10 may include a paperboard substrate and may also include a moisture resistant layer laminated together. It optionally includes an adhesive layer between the paperboard substrate and the tear resistant layer. The material of the paperboard substrate may be selected from any conventional paperboard, for example, ranging in weight upwardly from about 10 pt., preferably from about 11 pt. to about 14 pt. An example of such a substrate is a 14-point SBS board or CNK® board manufactured by WestRock Company. The paperboard substrate may be a bleached or unbleached board. The board may be coated on at least one side, optionally the side opposite the lamination, with a conventional coating selected for compatibility with the printing method and board composition.

The moisture resistant layer may be disposed over the uncoated side of the paperboard substrate and may be formed of polymeric material and secured to the substrate. The moisture resistant layer imparts toughness to the laminate structure. The moisture resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear or moisture resistance may also be used.

The adhesive layer may be formed of polyolefin material such as a low-density polyethylene (LDPE). The adhesive layer may be placed between the substrate and the tear/moisture resistant layer to secure the tear/moisture resistant layer to the substrate.

Suitable tear/moisture resistant materials may include, but not be limited to, tear resistant laminated sheet material, e.g., NATRALOCK® paperboard made by WestRock Company, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

In the embodiments detailed herein, the terms "carton" and "carrier" refer, for the non-limiting purpose of illustrating the various features of the invention, to a container for holding and carrying a product. It is contemplated that the teachings of the invention can be applied to various products as discussed above.

Referring to FIG. 1, it can be seen that the blank 10 comprises: a front wall panel 12; a bottom panel 14; a rear wall panel 16; a top panel 18 and a lid panel 20. The front wall panel 12, bottom panel 14, rear wall panel 16, top panel 18 and lid panel 20 are hinged one to the next in a linear series by means of fold lines 13, 15, 17, and 19.

The blank 10 comprises end closure structures for closing each end of a tubular structure that is defined by the plurality of main panels 12, 14, 16, 18, 20.

A first end closure structure 22*a*/24*a*/26*a* at least partially closes a first end of the tubular structure. The first end closure structure 22*a*/24*a*/26*a* comprises a plurality of end closure flaps 22*a*, 24*a*, 26*a* hinged along a first end of the blank 10. A first end closure flap 22*a* is hingedly connected to the front wall panel 12 by a hinged connection in the form of a fold line 21*a*. A second end closure flap 24*a* is hingedly connected to the bottom panel 14 by a hinged connection in the form of a fold line 23*a*. A third end closure flap 26*a* is hingedly connected to the rear wall panel 16 by a hinged connection in the form of a fold line 25*a*.

A second end closure structure 22*b*/24*b*/26*b* at least partially closes a second end of the tubular structure. The second end closure structure 22*b*/24*b*/26*b* comprises a plurality of end closure flaps 22*b*, 24*b*, 26*b* hinged along a second end of the blank 10. A fourth end closure flap 22*b* is hingedly connected to the front wall panel 12 by a hinged connection in the form of a fold line 21*b*. A fifth end closure flap 24*b* is hingedly connected to the bottom panel 14 by a hinged connection in the form of a fold line 23*b*. A sixth end closure flap 26*b* is hingedly connected to the rear wall panel 16 by a hinged connection in the form of a fold line 25*b*.

The second and fifth end closure flaps 24*a*, 24*b* form major end closure flaps. The first, third, fourth and sixth end closure flaps 22*a*, 26*a*, 22*b*, 26*b* form minor end closure flaps or "dust flaps".

The blank 10 comprises components for assembly into retaining devices S1, S2 (see FIG. 4). The retaining device is provided to securely maintain the film-roll 'R' within a dispensing-carton 90 formed from the blank 10; and to at least mitigate, if not prevent, unintentional egress of the film-roll 'R' out of the dispensing carton 90, particularly during dispensing of the film 'F'. Optionally, and as is the case in the illustrated arrangement, the blank 10 comprises components for forming two, oppositely arranged retaining devices. Each retaining device is formed from similar components, provided at opposite ends of the blank 10.

Top panel 18 is provided with a first and second retention tabs 30*a*, 30*b*. The first retention tab 30*a* is formed at the first end of the top panel 18; and the second retention tab 30*b* is formed at the second end of the top panel 18.

The first retention tab 30*a* is defined by a portion of fold line 17; a partial cut line 31*a* extending approximately perpendicularly relative to fold line 17 and terminating before reaching fold line 19 (see FIG. 1); and a severance line 29*a*. The severance line 29*a* may be formed from a series of cuts, interrupted by one or more temporarily connecting nick portions. The severance line 29*a* may comprise a series of three cuts interrupted by two temporarily connecting nick portions. The severance line 29*a* may be formed generally contiguously with the partial cut line 31*a*. The severance line 29*a* may be formed at an angle relative to the partial cut line 31*a*. The severance line 29*a* may extend toward the first-end edge of top panel 18 and may terminate at a location along that first end edge, which location is spaced from the fold line 19. An optional reverse partial cut 33*a* may be scored into the surface of the blank 10 sheet material and may be oriented substantially parallel to the partial cut line 31*a*. The reverse partial cut 33*a* may be formed on a side of the partial cut line 31*a* that is spaced further from the first-end edge of top panel 18 than the partial cut line 31*a*. The reverse partial cut 33*a* may taper at one end and terminate on the partial cut line 31*a*. The reverse partial cut 33*a* may terminate within the top panel 18 and before reaching fold line 17. By "reverse partial cut line" it is meant a cut, severance or other breakable line or demarcation that is made by cutting into the reverse (brown-side, non-coated side, inside surface) of the blank 10; that extends only partially and not completely through the substrate.

The second end closure flap 24*a* is provided with a first supplementary securing flap 28*a*, hingedly connected thereto by means of a hinge connection in the form of an alternating cut-crease line 27*a*. The first supplementary securing flap 28*a* is specifically dimensioned to have a width that is less than the width of the bottom panel 14 and the top panel 18. Further beneficially an edge of the first supplementary securing flap 28*a* may be shaped in a tapered manner in order to provide a narrower open region for the emerging or leading front edge of a film or sheet material 'F' as it is unwound from a roll. This is described in greater detail below. The first supplementary securing flap 28*a* may be shaped, dimensioned and arranged in a similar manner to the shape and size of the first retention tab 30*a*. The first supplementary securing flap 28*a* may be similarly shaped and dimensioned slightly smaller than the shape and size of the first retention tab 30*a*.

The second retention tab 30*b* is defined by a portion of fold line 17; a partial cut line 31*b* extending approximately perpendicularly relative to fold line 17 and terminating before reaching fold line 19 (see FIG. 1); and a severance line 29*b*. The severance line 29*b* may be formed from a series of cuts, interrupted by one or more temporarily connecting nick portions. The severance line 29*b* may comprise a series of three cuts interrupted by two temporarily connecting nick portions. The severance line 29*b* may be formed generally contiguously with the partial cut line 31*b*. The severance line 29*b* may be formed at an angle relative to the partial cut line 31*b*. The severance line 29*b* may extend toward the second-end edge of top panel 18 and may terminate at a location along that second-end edge, which location is spaced from the fold line 19. An optional reverse partial cut 33*b* may be scored into the surface of the blank 10 sheet material and may be oriented substantially parallel to the partial cut line 31*b*. The reverse partial cut 33*b* may be formed on a side of the partial cut line 31*b* that is spaced further from the second end edge of top panel 18 than the partial cut line 31*b*. The reverse partial cut 33*b* may taper at one end and terminate on the partial cut line 31*b*. The reverse partial cut 33*b* may terminate within the top panel 18 and before reaching fold line 17.

The fifth end closure flap 24*b* is provided with a second supplementary securing flap 28*b*, hingedly connected thereto by means of a hinge connection in the form of an alternating cut-crease line 27*b*. The second supplementary securing flap 28*b* is specifically dimensioned to have a width that is less than the width of the bottom panel 14 and the top panel 18. Further beneficially an edge of the second supplementary securing flap 28*b* is shaped in a tapered manner in order to provide a narrower open region for the emerging or leading front edge of a film or sheet material 'F' as it is unwound from a roll 'R'. This is described in greater detail below. The second supplementary securing flap 28*b* may be shaped, dimensioned and arranged in a similar manner to the shape and size of the second retention tab 30*b*. The second supplementary securing flap 28*b* may be similarly shaped to but dimensioned slightly smaller than the shape and size of the second retention tab 30*b*.

An optional feature 51 for enabling the lid panel 20 to be initially secured to the front wall panel 12, is provided by a plurality of (optionally) substantially circular glue pads 51 formed proximate an upper edge of the front wall panel 12. The glue pads 51 are each formed by a partial cut-line, such as but not limited to a half-depth cut line. Optionally the plurality of glue pads 51 comprises a series of 15 evenly spaced, uniformly sized, circular glue pads, arranged in a line spanning the length of the front wall panel 12. In other embodiments, the plurality of glue pads may comprise a different number of glue pads, which, may or may not be evenly spaced, uniformly sized or circular; and which may or may not be arranged in a single straight line.

The glue-pads 51 are optional, and if included, are provided for affixing the front wall panel 12 and the lid panel 20 together such that a carrier 90 having a securely enclosed tubular structure can be formed. A rolled-web 'R' of sheet material 'F' can be securely housed and retained, until it is required to open the carton 90 and commence dispensing of the web of sheet material 'F'.

As can be seen in FIG. 1, the lid panel 20 may comprise, at first and second ends thereof, linear, short crease or severance lines 35*a*; 35*b*, angled acutely with respect to the fold line 19. These short crease or severance lines 35*a*; 35*b* may aid in the manipulation of the lid panel 20 into a re-closed position, wherein the lid panel 20 sits inside of the front wall panel 12. The angled, short score lines 35*a*, 35*b* extending from end edges of the lid panel 20, may be useful when the lid panel 20 is manipulated such that at least part of its leading edge is caught within appropriately located slots formed by severance lines 37*b*, 37*a*.

The severance lines 37*b*, 37*a* are optionally provided in the front wall panel 12, at opposite ends thereof. The first and second severance lines 37*a*, 37*b* may each be formed as cut lines, optionally interrupted by small connecting portions.

The first severance line 37*a* extends in a generally perpendicular manner from the fold line 21*a* at the first-end of the blank 10 (and optionally disposed below the glue-pads 51), to a curved termination. The curved termination may be a curvilinear or J-shaped ending to the first severance line 37*a*, which may curve towards the bottom of the front wall panel 12, in a direction towards fold line 13.

Similarly, the second severance line 37*b* extends in a generally perpendicular manner from the fold line 21*b* at the second-end of the blank 10 (and optionally disposed below the glue-pads 51) to a curved termination. The curved termination may be a curvilinear or J-shaped ending to the second severance line 37*b*, which may curve towards the bottom of the front wall panel 12, in a direction towards fold line 13.

The first and second severance lines 37*b*, 37*a* provide a slot or catch, may be useful when the lid panel 20 is (repeatedly) manipulated into a re-closed position, and part of its leading edge can be caught within the appropriately located slots formed by the first and second severance lines 37*b*, 37*a*.

Turning to the construction of the carrier 90 (illustrated in FIGS. 2, 3 and 4), the carrier 90 may be formed by hand; or optionally, may be assembled by a series of sequential folding and adhering operations (not shown), in a machine. The folding process is not limited to that described below and may be altered according to particular manufacturing or processing requirements. In some arrangements the blank 10 may be folded-glued and part formed into a flat-collapsed carrier 90 for shipping and transport. The flat-collapsed carrier may be opened into an open-topped tubular structure, and a film-roll 'R' top-loaded into the tubular structure as described below. In the present illustrated arrangement, the folding carton 90 may be hand-assembled about a film roll 'R' from the blank 10.

For example, the blank 10, which may be pre-creased or pre-folded about its fold lines 13, 15, 17, 19, 21*a*, 23*a*, 25*a*, 21*b*, 23*b*, 25*b*, may be disposed on its outer facing side, with its inner-surface facing upwards. The front wall panel 12 may be folded, upwardly, about fold line 13; and the rear wall panel 16 may be folded, upwardly, about fold line 15. In this way, the front wall panel 12 and rear wall panel 16 are brought into spaced relationship and the outer surfaces of bottom panel 14 and front wall panel 12 may face outwards.

The first and second end closure structures 22*a*/24*a*/26*a*; 22*b*/24*b*/26*b* are then assembled in order to close the first and second ends of the tubular structure. The first and second end closure structures 22*a*/24*a*/26*a*; 22*b*/24*b*/26*b* are constructed in the same manner and therefore the assembly of the first and second end closure structures 22*a*/24*a*/26*a*; 22*b*/24*b*/26*b* will be described only once, with reference to the first end closure structure 22*a*/24*a*/26*a*; it being understood that the assembly of the second end closure structure 22*b*/24*b*/26*b*, is the same.

The first and third end closure flaps 22*a*, 26*a* are folded, approximately 90°, about fold lines 21*a* and 25*a* respectively. In this way the first open end is partially closed. Optionally, adhesive or other affixing means may be applied to the outer surfaces of the first and third end closure flaps 22*a*, 26*a*. The second end closure flap 24*a*, together with the first supplementary securing flap 28*a*, is folded about fold line 23*a* and brought into overlapping relationship with the first and third end closure flaps 22*a*, 26*a*. The second end closure flap 24*a* is thereby affixed to the first and third end closure flaps 22*a*, 26*a*, to thus form a first closed end of the carrier 90.

The second end is formed in the same way; and then, optionally, a roll of web 'R' may be placed onto the inside surface of the bottom panel 14.

The first and second supplementary securing flaps 28*a*, 28*b* may be folded, approximately 90°, about fold lines 23*a* and 23*b* respectively; relative to the second and fifth end closure flaps 24*a*, 24*b*. Glue, adhesive or other suitable affixing means may be applied to the outer surface of the first and second supplementary securing flaps 28*a*, 28*b* in readiness for attaching the first and second supplementary securing flaps 28*a*, 28*b* to the first and second retention tabs 30*a*, 30*b* of the top panel 18.

Glue, adhesive or other suitable affixing means may be applied to the glue-pad regions 51. The top panel 18, together with the lid panel 20 may then be folded about fold lines 17 and 19 (by approximately 90°), in order to bring the inner surface of the top panel 18 into a spaced and opposing position facing the bottom panel 14; and to bring the inner surfaces of the first and second retention tabs 30*a*, 30*b* of the top panel 18 into face to face contacting relationship with the first and second supplementary securing flaps 28*a*, 28*b*, such that the first and second supplementary securing flaps 28*a*, 28*b* are attached to the first and second retention tabs 30*a*, 30*b*.

The lid panel 20 may then be further folded about fold line 19 (approximately by another 90°) in order to bring the inner surface of the lid panel 20 into face to face contacting relationship with part of the front wall panel 12, such that the lid panel 20 is affixed to the front wall 12. In this way a fully enclosed tubular carton 90 is formed in which the roll 'R' is securely housed. See FIG. 2.

To access the roll 'R', the lid panel 20 is broken free of its connection to the front wall panel 12. This may be achieved by the application of sufficient pulling force on the lid panel 20 in a direction away from the front wall panel 12, such that the glue pads 51, (which are formed by a partial cut-line), are torn out of the front wall panel 12. The adhesive bond between the lid panel 20 and the glue pads 51 being stronger than the internal fibre bond of the paperboard material within the glue pads 51.

Once the lid panel 20 is released from its attachment to the front wall panel 12, then the top panel 18 can be folded outwardly about fold line 17 in order to expose the roll 'R' disposed within the carrier 90. In moving the top panel 18 in this way, the reverse partial cuts 33*a*, 33*b*; the partial cut lines 31*a*, 31*b*; and the temporarily connecting nick portions interrupting the severance lines 29*a*, 29*b* are all broken and the first and second retention tabs 30*a*, 30*b* are separated from the top panel 18, remaining, instead firmly affixed to the first and second supplementary securing flaps 28*a*, 28*b* respectively. The combination of the partial cut lines 31*a*; 31*b* relative to the reverse partial cuts 33*a*; 33*b* allows, an approximately half-depth portion $T_1$, of the top panel 18 to be torn out from the main remaining section of top panel 20. These approximately half-depth torn-out portions $T_1$ of the top panel 18 remain contiguous with the first and second retention tabs 30*a*, 30*b*. Corresponding, approximately half-depth portions $T_2$, remain attached and contiguous with the top panel 18. This is illustrated in FIG. 3.

Also shown in FIG. 3 is the manner in which the retaining devices S1, S2, overhang the roll 'R', such that, even in an open condition (such as that shown in FIGS. 3 and 4), if the carrier 90 was inverted, the roll 'R' would not just drop freely from the carrier 90, but instead, would be held or retained therein by the presence of the retaining devices S1, S2.

To remove a section of the film 'F' from the roll 'R', a free end 'E' of the film 'F' is located withdrawn from the carton 90 as shown in FIG. 4. With the roll 'R' prevented from inadvertently falling out of the carton 90, a user can support the carton 90 with one hand; and withdraw the film 'F' by pulling it (causing the roll 'R' to rotate) with their other hand. Upon withdrawal of sufficient film 'F', the dispensed portion can be cut or otherwise separated and the carrier 90 can be reclosed.

The free-end edge 'E' of the roll of film 'F' can be placed inside the carrier 90 and the top panel 18 and lid 20 folded back into the original positions in order to re-close the carton 90. With the feature 51 for enabling the lid panel 20 to be initially secured to the front wall panel 12 having been utilized, the lid panel 20 can now be retained in a re-closed position by catching end sections of the lid panel 20 into the slots, which may need to be formed by breaking any small connecting portions interrupting the severance lines 37*b*, 37*a* provided in the front wall panel 12.

Alternatively, the lid panel can be folded inside of the front wall panel 12 and held in a re-closed position in that manner (thus the slots formed by the severance lines 37*b*, 37*a* being entirely optional).

The first and second supplementary securing flaps 28*a*, 28*b*; as well as the first and second retention tabs 30*a*, 30*b* are specifically dimensioned to have a width that is less than the width of the bottom panel 14 and the top panel 18. In this way the retaining devices S1, S2 formed therefrom are not full-width and stop short of reaching the front wall panel 12. See FIGS. 3 and 4. This provides space for the emerging or leading front edge 'E' of the film 'F' to be withdrawn from the roll 'R'.

The first and second supplementary securing flaps 28*a*, 28*b* as well as the first and second retention tabs 30*a*, 30*b*, may be shaped in a tapered manner at their front edges (as viewed in FIGS. 3 and 4—i.e. the edges closest to the front wall 12) in order to provide not only a narrower open region for the emerging or leading front edge 'E' of a film or sheet material 'F' as it is unwound from a roll, but also to optionally provide a guide for the film 'F'.

By integrally forming each retaining device S1, S2 from material folded to the body of the carton 90, the retaining devices S1, S2, are easily created, without the necessity for much, if any, additional material beyond that required to fully enclose a roll 'R'. Furthermore, by a first portion (first retention flap 30*a*) of the retaining device S1 being hinged to the rear wall panel 16 of the carton 90; and by a second portion (first supplementary securing flap 28*a*) of the retaining device S1 being hinged to the first end closure structure, the retaining device has sufficient rigidity to at least mitigate against, if not prevent, inadvertent dropping of the roll from the carton 90. At the same time, should it be required to remove the roll 'R' (for example to locate the free end edge 'E') from the carton 90, the retaining devices S1, S2, each have enough natural resilience that either of them can be displaced (upwardly) a sufficient extent to enable a user to deliberately and purposefully manipulate the roll out of the carton 90 and still return to their normal, retaining position afterwards.

It can be appreciated that various changes may be made within the scope of the present invention. For example, the size and shape of the panels and apertures may be adjusted to accommodate rolls of differing, length and diameter. In some arrangements the provision of only one retaining device S1 at one end of the carton may be sufficient; however, it is considered to be of particular benefit to have a retaining device at each end of the roll.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cut line, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels.

For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton for storing and dispensing a rolled web of material, the carton comprising:

a tubular roll storage container defined by a rear wall panel, a front wall, a first end wall, and a second end wall;

a closure that is hinged to the rear wall panel, the closure comprising a top panel and a lid panel hinged thereto; and at least a first retaining device comprising:

a first portion that is formed from the top panel and is hinged to the rear wall panel; and a second portion hinged to the first end wall, said first and second portions being affixed together.

2. A carton according to claim 1 wherein the carton is a folded paperboard carton.

3. A folded paperboard carton for storing and dispensing a rolled web of material, the carton comprising:

a tubular roll storage container defined by a rear wall panel, a front wall, a first end wall and a second end wall;

a closure that is hinged to the rear wall panel, the closure comprising a top panel and a lid panel hinged thereto; and at least a first retaining device comprising:

a first portion hinged to the rear wall panel; and a second portion hinged to the first end wall, said first and second portions being affixed together, wherein said first retaining device has a width that is less than the width of the first end wall; and wherein said first retaining device is free of direct connection to the front wall.

4. A folded paperboard carton according to claim 3 wherein the affixed first and second portions are spaced from and overhang a bottom wall of the carton formed by a bottom panel.

5. A folded paperboard carton according to claim 4 wherein a front edge of said first retaining device is spaced from the front wall and is acutely angled relative to a top edge of the first end wall.

6. A folded paperboard carton according to claim 5 wherein said first portion of said first retaining device is provided by a first retention tab that is formed from part of the top panel.

7. A folded paperboard carton according to claim 6 wherein said first portion of said first retaining device is defined by: a free edge of the top panel; part of a fold line between the top panel and the rear wall panel; a severance line which defines said front edge; and a partial cut line.

8. A folded paperboard carton according to claim 7 wherein said partial cut line extends approximately perpendicularly relative to said fold line between the top panel and the rear wall panel; and wherein said severance line is formed generally contiguously with the partial cut line and extends at an angle relative thereto.

9. A folded paperboard carton according to claim 8 wherein said first portion of said first retaining device is further defined by a reverse partial cut oriented substantially parallel to the partial cut line, and wherein said reverse partial cut is angled at one end and terminates on said partial cut line.

10. A folded paperboard carton according to claim 9 wherein a thin section of the first portion of said first retaining device has a thickness that is less than the thickness of the remainder of the first portion; and wherein the thin section of the first portion is defined by the partial cut line and the reverse partial cut.

11. A folded paperboard carton according to claim 2 wherein the first end wall comprises: first, second and third end closure flaps hinged to the front wall, a bottom wall and the rear wall panel respectively, the first, second and third end closure flaps being affixed together and wherein said second portion of said first retaining device is provided by a first supplementary securing flap that is hinged by a fold line to the first end wall.

12. A folded paperboard carton according to claim 11 wherein the first supplementary securing flap is hinged by a fold line to the second end closure flap.

13. A folded paperboard carton according to claim 2 having a second retaining device, the second retaining device being formed at the opposite end of the tubular roll storage container to the first retaining device, wherein the first retaining device and the second retaining device are configured to retain an article in roll form within the carton.

14. A folded paperboard carton according to claim 13 wherein the second retaining device comprises: a first portion hinged to the rear wall panel; and a second portion hinged to the second end wall and wherein the first and second portions are affixed together.

15. A folded paperboard carton according to claim 14 wherein said second retaining device has a width that is less than the width of the first end wall, wherein said second retaining device is free of direct connection to the front wall; and wherein a front edge of said second retaining device is spaced from the front wall and is acutely angled relative to a top edge of the first end wall.

16. A folded paperboard carton according to claim 15 wherein said first portion of said second retaining device is provided by a second retention tab that is formed from part of the top panel; and is defined by: a free edge of the top panel; part of a fold line between the top panel and the rear wall panel; a severance line which defines said front edge; and a partial cut line.

17. A folded paperboard carton according to claim 16 wherein said partial cut line extends approximately perpendicularly relative to said fold line between the top panel and the rear wall panel; wherein said severance line is formed generally contiguously with the partial cut line and extends at an angle relative thereto; wherein said first portion of said second retaining device is further defined by a reverse partial cut oriented substantially parallel to the partial cut line; and wherein said reverse partial cut is angled at one end and terminates on said partial cut line.

18. A folded paperboard carton according to claim 17 wherein a thin section of the first portion of said second retaining device has a thickness that is less than the thickness of the remainder of the first portion; and wherein the thin section of the first portion is defined by the partial cut line and the reverse partial cut.

19. A folded paperboard carton according to claim 13 wherein the second end wall comprises: fourth, fifth and sixth end closure flaps hinged to the front wall, a bottom wall and the rear wall respectively, the fourth, fifth and sixth end closure flaps being affixed together and wherein said second retaining device is provided by a second supplementary securing flap that is hinged by a fold line to the second end wall.

20. A folded paperboard carton according to claim 19 wherein the second supplementary securing flap is hinged by a fold line to the fifth end closure flap.

21. A blank for forming the carton according to claim 1.

22. A foldable paperboard blank for forming a folded paperboard carton for storing and dispensing a rolled web of material, the blank comprising:

a rear wall panel, a bottom panel, a front wall panel, flaps for forming a first end wall, and flaps for forming a second end wall, which together define a tubular roll storage container;

panels for forming a closure comprising:

a top panel; and a lid panel, the lid panel being connected to the top panel along a fold line; and components for forming at least a first retaining device, said components comprising:

a first portion hinged to the rear panel; and a second portion hinged to a flap among the flaps for forming the first end wall, the first and second portions for being affixed together, wherein said first portion of said first retaining device is provided by a first retention tab that is formed from the top panel.

23. A foldable paperboard blank according to claim 22 wherein said first portion of said first retaining device is defined by: a free edge of the top panel; part of a fold line between the top panel and the rear wall; a severance line which defines said front edge; and a partial cut line, wherein said partial cut line extends approximately perpendicularly relative to said fold line between the top panel and the rear wall; and wherein said severance line is formed generally contiguously with the partial cut line and extends at an angle relative thereto.

24. A folded paperboard blank according to claim 23 wherein said first portion of said first retaining device is further defined by a reverse partial cut oriented substantially parallel to the partial cut line, and wherein said reverse partial cut is angled at one end and terminates on said partial cut line.

25. A folded paperboard blank according to claim 22 wherein the components for forming the first end wall comprise: first, second and third end closure flaps hinged to the front wall, bottom wall and rear wall respectively, wherein said second portion of said first retaining device is provided by a first supplementary securing flap that is hinged by a fold line to the second end closure flap.

26. A folded paperboard blank according to claim 25 having components for forming a second retaining device comprising: a first portion hinged to the rear panel; and a second portion hinged to a flap for forming the second end wall, wherein the first and second portions are for being affixed together, and wherein said first portion of said second retaining device is provided by a second retention tab that is formed from material that would otherwise have formed part of the top panel; and is defined by: a free edge of the top panel; part of a fold line between the top panel and the rear wall; a severance line which defines said front edge; and a partial cut line.

27. A folded paperboard blank according to claim 26 wherein said partial cut line extends approximately perpendicularly relative to said fold line between the top panel and the rear wall panel; wherein said severance line is formed generally contiguously with the partial cut line and extends at an angle relative thereto; wherein said first portion of said second retaining device is further defined by a reverse partial cut oriented substantially parallel to the partial cut line; and wherein said reverse partial cut is angled at one end and terminates on said partial cut line.

28. A folded paperboard blank according to claim 26 wherein the second end wall comprises: fourth, fifth and sixth end closure flaps hinged to the front wall, bottom wall and rear wall respectively, the fourth, fifth and sixth end closure flaps for being affixed together and wherein said second portion of second first retaining device is provided by a second supplementary securing flap that is hinged by a fold line to first end wall.

* * * * *